United States Patent [19]

Eriksson

[11] Patent Number: 4,944,338

[45] Date of Patent: Jul. 31, 1990

[54] BARKING METHOD, AND AN APPARATUS FOR UTILIZATION OF THE METHOD

[76] Inventor: Kjell-Anders Eriksson, Fiskgatan 10, Leksand, Sweden, S-793 00

[21] Appl. No.: 252,455

[22] PCT Filed: Mar. 25, 1987

[86] PCT No.: PCT/SE87/00154

§ 371 Date: Sep. 27, 1988

§ 102(e) Date: Sep. 27, 1988

[87] PCT Pub. No.: WO87/05851

PCT Pub. Date: Oct. 8, 1987

[30] Foreign Application Priority Data

Mar. 27, 1986 [SE] Sweden ..... 86014495

[51] Int. Cl.[5] ..... B27L 1/00

[52] U.S. Cl. ..... 144/208 E; 144/208 R; 144/342

[58] Field of Search ..... 144/208 R, 208 E, 341, 144/342

[56] References Cited

U.S. PATENT DOCUMENTS 2,775,274 12/1956 Andersson ..... 144/208 E
3,098,512 7/1963 Kendrick ..... 144/208 E
4,425,951 1/1984 Pousette et al. ..... 144/208 E

FOREIGN PATENT DOCUMENTS 701563 1/1965 Canada ..... 144/208 E
972444 7/1959 Fed. Rep. of Germany ... 144/208 E

*Primary Examiner*—W. Donald Bray
*Attorney, Agent, or Firm*—Fleit, Jacobson, Cohn, Price, Holman & Stern

[57] ABSTRACT

A barking method, and an apparatus for utilization of the method, wherein a log (6) during a substantially linear feeding movement is brought to pass one or a number of barking devices (1; 4,4'), arranged to perform a surrounding rotary movement in relation to the log (6), the barking devices (1; 4, 4') are pressed into a contact position against the log by centrifugal force during the surrounding rotary movement in relation to the log, and the contact pressure of the barking devices (1; 4, 4') is continuously variable by increasing/decreasing the rotary speed of the barking devices (1; 4, 4') and the cutters are arranged inclined at an angle in relation to the feed direction of the log (6), to produce a feeding movement for the log (6) in a direction through the barking device (1; 4, 4').

17 Claims, 2 Drawing Sheets

BARKING METHOD, AND AN APPARATUS FOR UTILIZATION OF THE METHOD

BACKGROUND OF THE INVENTION

The present invention relates to a barking method, and a device for utilization of the method.

It is previously known to perform barking of a log while the log is made subject to a linear displacement movement through and past a barking apparatus. As examples of such barking methods can be mentioned barking using barking means such as a chain, wire or similar device, which is brought to take up frictional contact against the log to be barked, as for example as disclosed in Swedish Patent SE 122 987, SE 124 273, SE 130 000, SE 139 367 or SE 145 114, and with necessary contact force being obtained by means of one or a number of spring members. An alternative embodiment, including a triangular link system carrying a barking knife and with springs causing contact pressure, and including a motor driven drive means, is disclosed in CH 233 629, as a complete unit intended to perform a rotary movement along a tree, thereby performing a surrounding barking operation by means of the barking knife.

Previously known methods do not facilitate adjustment of the removal capacity during the barking operation, since the contact pressure of the barking member against a log is entirely related to the force applied by the springs used. An ideally suited barking method should allow for such a continuous adjustment of the removal capacity, which should be related to the type of log, but also the existing season of the year, since barking can be performed with less contact pressure at higher temperature (summer time) than at a lower temperature (winter time). The spring members are also less suited for location within a barking unit, since small bark fragments can be located between adjacent turns in the springs, and thus completely change a predetermined contact pressure for the spring loaded barking members.

BRIEF SUMMARY OF THE INVENTION

The object of the present invention is to disclose a barking method, and an apparatus for utilization of the method, offering the possibility to continuously change the barking depth during operation, without changing the feeding speed of the log, and also removing the problems of changes in contact pressure related to previously known spring loaded barking member. Furthermore, the present invention also makes it possible to perform barking with a barking unit having an extremely uncomplicated design, having high dependability in operation, low manufacturing costs, and requiring a minimum of maintenance.

The method according to the present invention comprises causing a log during a substantially linear feed movement to pass one or a number of barking means, arranged to perform a surrounding and rotary movement in relation to the log, and it is mainly characterized in that the barking means by influence from centrifugal force during the surrounding and rotary movement in relation to the log are pressed against the log, and that the contact pressure of the barking means is continuously variable by an increase/decrease of the rotary speed for the barking means in relation to the log.

The apparatus for utilization of the method according to the invention includes a rotary member through which a log is arranged to pass during a linear feed movement in the longitudinal direction of the log, the rotary member being arranged to support barking means, arranged to debark a log by means of frictional contact or a cutting operation, and it is mainly characterized in that the barking means are arranged attached or joined with means which under influence of centrifugal force press the barking means with a contact pressure related to the rotary speed of the rotary member.

BRIEF DESCRIPTION OF THE DRAWINGS

A number of non-restricting examples of embodiments of an apparatus for utilization of the method according to the present invention are more fully described below with reference to the accompanying drawings, wherein.

DETAILED DESCRIPTION

Figure 1:
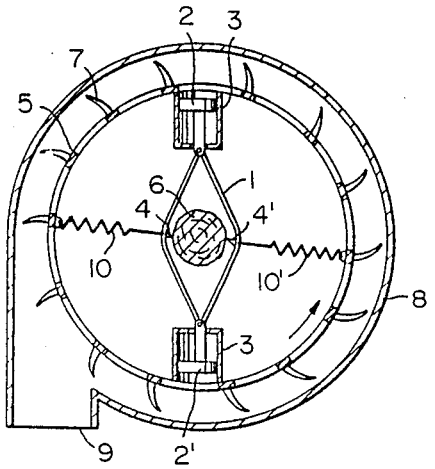
FIG. 1 is a cross-sectional view of a first embodiment of an apparatus for utilization of the method according to the invention.

With reference to FIG. 1, a first embodiment according to the present invention is shown, comprising a sling shaped member 1 formed from a chain, wire or similar element, attached at two opposed points against two pistonshaped counterweights 2, 2', axially displacable in a surrounding tubular member 3, 3', respectively. The member 1 may advantageously be arranged to carry at least two cutting means 4, 4', located in an intermediate position in relation to the attachment points for the member 1 against the counterweights 2, 2'. The tubular members 3, 3' are arranged attached against a drum shaped member 5, arranged to perform a rotary movement in relation to a log 6 moved through the member 1. It is further shown how the member 5 can be arranged with outwardly extending fan wings 7, arranged to cause an air stream in a surrounding housing 8 having an outlet opening 9 for removed bark. The member 5 is arranged with peripherally located through openings, through which removed bark can be thrown out, thereafter being transported by the air stream in the housing 8 to the outlet opening 9. Furthermore, two spring means 10, 10' are shown, attached to the member 1 at points within an intermediately located region in relation to the attachment points for the member 1 to the counterweights 2, 2', intended to assure that the member 1 is opened maximally when the member 5 does not rotate, or rotates at a low speed. It should be noted, that such spring means 10, 10' are not always required for applications in which the member 5 is maintained rotating with a low rotary speed when a log 6 is inserted into the member 1, since the member 1 due to its own weight, and the lesser influence from centrifugal force at low speed, can take up such a configuration that insertion of the log 6 is facilitated.

Operation, a log 6 is inserted into the member 5 into a position where a first end portion is surrounded by the member 1, whereafter the rotary speed of the member 5 is increased. As a result, the piston shaped counterweights 2, 2' are made subject to a centrifugal force and perform a displcement movement in relation to the surrounding tubular members 3, 3' in direction away from the rotary center of member 5, whereby the member 1 is stretched, and the intermediate part is pressed in direction inwardly against the outer peripheral surface of the log 6. The cutting means 4, 4' are thereby obviously also pressed into contact with log 6, while rotated with member 1 by means of the member 5, and perform surrounding debarking of the log 6. Since the log simultaneously is fed with a linear movement through the member 5, debarking is performed over the entire length of the log 6.

Figure 2:
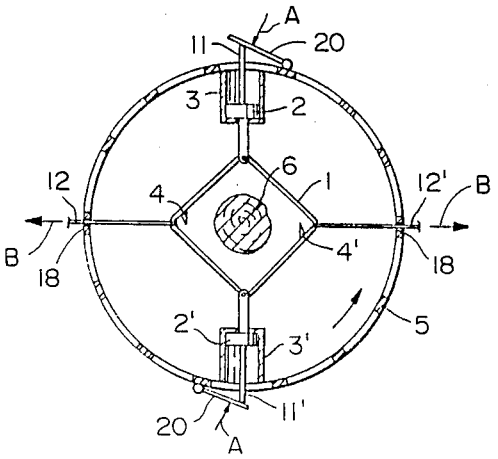
FIG. 2 is a view substantially corresponding to FIG. 1, and showing the first embodiment slightly modified.

Since it is undesirable for certain applications to reduce the rotary speed of the member 5 when a log 6 is inserted, as well as stopping the rotary movement of member 5 completely, it is obviously also possible to use forced control to move the counterweights 2, 2' in direction towards the center of the member 5 while it is rotating with a rotary speed adapted for barking. This alternative possibility is basically illustrated in FIG. 2, in which the counterweights 2, 2' are arranged with stud shaped members 11, 11' extending in direction substantially raidially outwardly relative to member 5 and engaged at their ends by force applying members, such as levers 20, for example. It is further shown, how previously discussed spring means 10, 10', which obviously can be used to accomplish an opening movement for the sling 1, can be replaced by two wires 12, 12' or similar element, each one attached to a centrally located part of member 1, and extending through apertures 18 to a point outside the peripheral surface of member 5. By influencing members 11, 11' with forces in the directions of arrows A, and/or the wires 12, 12' with forces in the directions indicated by arrows B, an opening movement can be performed, despite a high rotary speed being maintained for membef 5. As soon as the forces applied are removed, the member 1 with associated cutting members 4, 4' return to a contact position pressed against an inserted log 6.

Figure 3:
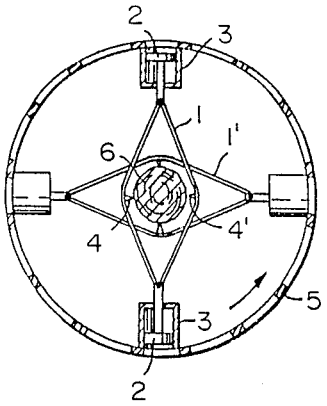
FIG. 3 is a cross-sectional view of a second embodiment for utilization of the method according to the invention.

FIG. 3 is only intended to disclose how the number of sling shaped members 1 can be varied as described, and shows an embodiment corresponding to FIG. 1, but including two sling shaped members 1, 1'. It should be noted, that the number of members 1, 1' can be increased further, in which case these are located successively following each other in the member 5.

It should also be noted, that previously mentioned cutting members 4, 4' also can be excluded, i.e. necessary debarking can often be performed by means of frictional contact between member 1 and log 6.

Figure 4:
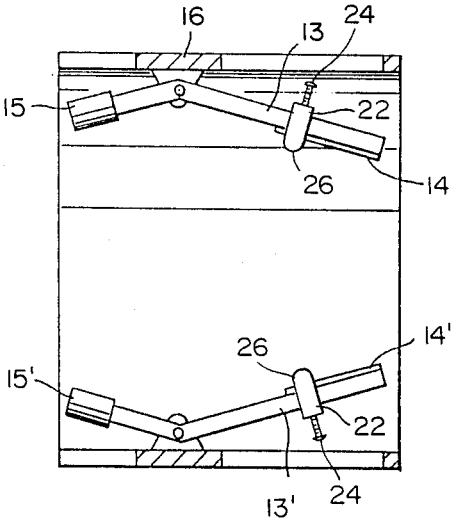
FIG. 4 is longitudinal cross-sectional view of a third embodiment for utilization of the method according to the invention.
Figure 5:
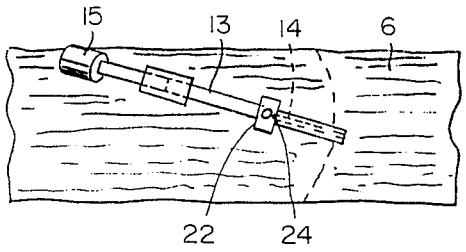
FIG. 5 is a plan view of a barking means included in the embodiment shown in FIG. 4.

The use of centrifugal force for obtaining required contact pressure for the barking means also makes other embodiments possible, and such a further example is shown in FIGS. 4 and 5. According to this embodiment, chains, wires or similar elements are not used to accomplish barking, or to carry cutting members, intended to perform barking. Instead one or preferably a number of barking means are used, comprising a pivotally attached member 13, 13', adjacent to a first end portion carrying a cutting means 14, 14', and adjacent to a second end portion carrying a counterweight 15, 15'. Members 13, 13' are supported by a rotary member 16, into which a log 6 is insertable, and through which it is moved in a substantially linear feeding movement. By imposing a rotary movement on the rotary member 16, the counterweights 15, 15' are made subject to a centrifugal force, causing the counterweights 15, 15' to move in direction away from the rotary center of the rotary member 16. As a result, the pivotally attached members 13, 13' perform a pivoting movement, whereby the cutting means 14, 14' carried adjacent to the first end portion are pressed against the periphral surface of the log 6, and perform debarking.

By arranging the cutting means 14, 14' inclined in relation to the longitudinal direction of the log, a further advantage is obtained, since the log is made subject to a feeding movement, as schematically illustrated in FIG. 5. This feature may for many applications result in that a separate feeding device for the linear displacement movement of the log 6 is not required.

Possibility to insert a log 6 while maintaining a rotary speed for barking is also offered, e.g. by restricting the pivoting movement of the pivotally attached members 13, 13' in direction towards each other, or by causing a forced opening movement thereof, e.g. by a forced movement of the counterweights 15, 15' in direction towards the rotary center of the rotary member 16 with a means not shown. Insertion at a reduced rotary speed can obviously also be performed.

The removal capacity can be affected by influencing the linear feed speed of the log 6, and also by changes in the rotary speed of the barking means around the log 6. An increased rotary speed will obviously result in an increased contact pressure, and a reduction of the contact pressure is accomplished by a reduction of the rotary speed.

The present invention thus makes it possible to use centrifugal force to obtain required contact pressure when barking, and also a previously unknown method to vary said contact pressure in a simple way. It is further possible to accomplish fast and continuous barking of successively following logs, and simple and reliable technical designs are also provided.

The embodiments shown and described are only intended to serve as examples of embodiments within the scope of the invention and the following claims, since many modifications obviously can be made, in order to meet specific requirements. Also with regard to the embodiment of FIGS. 4 and 5, advantageously the pivotally attached members 13, 13' obviously can be arranged with feeler means for contacting the peripheral surface of the log 6, intended to serve as barking depth restricting means, and which thus restrict the depth to which the cutting means 14, 14' can penetrate into a log 6. Such a feeler means may be for example a sleeve shaped member 22 slidably engageable on each arm of members 13, 13', on which cutting means 14, 14' are mounted, having set screw 24 thereon in a well known manner for engaging with and clamping member 22 in a desired position so that the inner end 26 thereof engages log 6 to limit the inward movement of the cutting means.

I claim:

1. In a barking apparatus wherein a log is moved in a substantially linear feeding direction in the direction of its longitudinal axis through a barking means rotating around the log and urged into engagement with the periphery of the log by centrifugal force, the improvement comprising:

a rotating member:

an opening through said rotating member for receiving the log therethrough;

at least one barking device movably mounted on said rotating member for rotation therewith and projecting into said opening for engagement with the peripheral surface of the log;

centrifugal force operated means operatively connected to said at least one barking device for controlling the contacing pressure of said barking device against the peripheral surface of the log proportionally to the speed of rotation of said rotating member; and co-acting means operatively associated with said barking device to positively cause disengagement of said barking device at predetermined rotating speeds of said rotating member.

2. Apparatus as claimed in claim 1 wherein:

said at least one barking device comprises a pivoting member having two parts extending from a juncture thereof, means for pivotally connecting said pivoting member to said rotating member substantially at said juncture of said two parts, and a cutting means on one of said two parts in a position for engagement with the periphery of the log when said rotating member is rotated, said cutting means extending substantially linearly at an angle with respect to the longitudinal axis of the log so that rotation of said rotating member causes engagement of said cutting means with the peripheral surface of the log for cutting the peripheral surface and said rotation in combination with said angle of said cutting means simultaneously produces a force on the log substantially in the direction of the longitudinal axis of the log for feeding the log in a feeding direction substantially linearly through said rotating member; and said centrifugal force operated means comprises a counterweight on the other of said two parts for producing said centrifugal force.

3. Apparatus as claimed in claim 2 wherein: said pivoting member comprises an elbow shaped member:

said two parts of said pivoting member comprise arms extending substantially linearly from said juncture;

said cutting means is on one of said arms;

said counterweight is one the other of said arms; and at least said one arm extends at said angle from said juncture.

4. Apparatus as claimed in claim 2 wherein:

said rotating member comprises a drum shaped member having an inner surface; and said at least one barking device is mounted on said inner surface.

5. Apparatus as claimed in claim 4 wherein:

said at least one barking device comprises a plurality of barking devices mounted on said inner surface evenly spaced circumferentially.

6. Apparatus as claimed in claim 5 wherein:

each pivoting member comprises an elbow shaped member;

said two parts of each pivoting member comprise arms extending substantially linearly from said juncture;

said cutting means is one one of said arms of each pivoting member;

said counterweight is on the other of said arms of each pivoting member; and at least said one arm of each pivoting member extends at said angle from said juncture.

7. Apparatus as claimed in claim 3 and further comprising:

a feeler means adjustably mounted on said one arm for movement therealong for engagement with the peripheral surface of the log to limit the depth of cutting of said cutting means.

8. Apparatus as claimed in claim 1 wherein:

said co-acting means comprises spring means having a first end connected to said rotating member and a second end connected to said barking device for applying a resilient force opposing the force on said barking device produced by rotation of said rotating member.

9. Apparatus as claimed in claim 1 wherein:

said co-acting means comprises means connected to said barking device for applying a predetermined force opposing the force on said barking device produced by rotation of said rotating member.

10. In a barking apparatus wherein a log is moved in a substantially linear feeding direction in the direction of its longitudinal axis through a barking means rotating around the log and urged into engagement with the periphery of the log by centrifugal force, the improvement comprising:

a rotating member:

an opening through said rotating member for receiving the log therethrough;

at least one barking device movably mounted on said rotating member for rotation therewith and projecting into said opening for engagement with the peripheral surface of the log and comprising at least one sling shaped elongated rope-like member disposed in said opening of said rotating member and having opposite ends, and cutting means on said sling shaped member engageable with the peripheral surface of a log in said opening, said ends of said sling shaped member being connected to said at least two counterweights so that rotation of said rotating member rotates said sling shaped member and said counterweights and displaces said counterweights away from each other to apply a stretching force on said sling shaped member and engage said cutting means against the peripheral surface of a log disposed in said opening in said rotating member; and centrifugal force operated means operatively connected to said at least one barking device for controlling the contacting pressure of said barking device against the peripheral surface of the log proportionally to the speed of rotation of said rotating member and comprising at least two counterweights movably mounted on said rotation of said rotating member for linear displacement in opposite directions.

11. Apparatus as claimed in claim 10 wherein:

said barking device comprises elongated sling shaped two rope like members disposed on opposite sides of a log in use and cutting means on each rope like member for engagement against opposite sides of the log.

12. Apparatus as claimed in claim 10 wherein:

said sling shaped rope like member surrounds a log in use; and said cutting means comprises at least two cutting members engageable against opposite sides of the log so that rotation of said rotating means causes said cutting members, to move toward the center of rotation of said rotating means.

13. Apparatus as claimed in claim 10 and further comprising:

co-acting means operatively associated with said barking device to positively cause disengagement of said barking device at predetermined rotating speeds of said rotating member.

14. Apparatus as claimed in claim 12 and further comprising:

co-acting device operatively associated with said barking means to positively cause disengagement of said barking device at predetermined rotating speeds of said rotating member.

15. Apparatus as claimed in claim 14 wherein:

said co-acting means comprises spring means having a first end connected to said rotating member and a second end connected to said barking device for applying a resilient force opposing the force on said barking device produced by rotation of said rotating member.

16. Apparatus as claimed in claim 13 wherein:

said co-acting means comprises means connected to said barking device for applying a predetermined force opposing the force on said barking device produced by rotation of said rotating member.

17. Apparatus as claimed in claim 15 wherein:

said spring means comprises two tension springs each having a first end connected to said rotating member and a second end connected to said rope like member; and the force of said tension springs is sufficient to disengage said cutting members from the log and displace said cutting members apart a distance to allow insertion of the log between said cutting members when said rotating member is stopped and is insufficient to prevent engagment of said cutting members with the log when said rotating member is rotated above a predetermined speed for barking.

* * * * *